US007185567B2

(12) United States Patent
Ide

(10) Patent No.: US 7,185,567 B2
(45) **Date of Patent: *Mar. 6, 2007**

(54) TORQUE PLATE TOOL AND METHOD FOR SPRINKLER HEAD INSTALLATION

(75) Inventor: Stephen R. Ide, Nazareth, PA (US)

(73) Assignee: Victaulic Company, Easton, PA (US)

( * ) Notice: Subject to any disclaimer, the term of this patent is extended or adjusted under 35 U.S.C. 154(b) by 126 days.

This patent is subject to a terminal disclaimer.

(21) Appl. No.: 11/077,529

(22) Filed: Mar. 10, 2005

(65) Prior Publication Data

US 2006/0201286 A1 Sep. 14, 2006

(51) Int. Cl.
*B25B 13/48* (2006.01)

(52) U.S. Cl. ..... 81/176.15; 81/124.2

(58) Field of Classification Search ..... 81/176.15, 81/177.1, 124.2, 176.2
See application file for complete search history.

(56) References Cited

U.S. PATENT DOCUMENTS

| | | | | |
|---|---|---|---|---|
| 432,403 | A | 7/1890 | Grinnel | |
| D26,255 | S | 11/1896 | Esty | |
| D184,373 | S | 2/1959 | Rider | |
| D210,457 | S | 3/1968 | Mease | |
| 3,388,747 | A | 6/1968 | Hodnett | |
| 3,801,014 | A | 4/1974 | Cantales | |
| 3,971,443 | A | 7/1976 | Zenker | |
| 4,215,751 | A * | 8/1980 | Mears | 169/51 |
| 4,335,074 | A * | 6/1982 | Bernas | 81/176.1 |
| 4,676,320 | A * | 6/1987 | Capasso | 81/176.2 |
| 5,048,378 | A * | 9/1991 | Nikolas | 81/124.2 |
| 5,097,906 | A | 3/1992 | Polan | |
| 5,234,059 | A | 8/1993 | Eynon | |
| 5,447,338 | A | 9/1995 | Kikuchi | |
| 5,570,745 | A | 11/1996 | MacDonald, III | |
| 5,632,339 | A | 5/1997 | Fenske et al. | |
| 5,743,337 | A | 4/1998 | MacDonald, III | |
| 5,893,418 | A | 4/1999 | Ponte | |
| 6,131,822 | A | 10/2000 | Farmer, Jr. | |
| 6,487,942 | B1 * | 12/2002 | Carter et al. | 81/426.5 |
| 6,669,111 | B2 * | 12/2003 | Vinson et al. | 239/288 |
| D498,818 | S | 11/2004 | Ide et al. | |
| D504,494 | S | 4/2005 | Ide et al. | |
| 7,055,614 | B1 * | 6/2006 | Ide | 169/37 |
| 2003/0173094 | A1 | 9/2003 | Vinson et al. | |
| 2005/0035022 | A1 | 2/2005 | Ide et al. | |

* cited by examiner

*Primary Examiner*—Hadi Shakeri
(74) *Attorney, Agent, or Firm*—Synnestvedt & Lechner LLP

(57) ABSTRACT

A tool and a method for installing a sprinkler head in a threaded fitting of a fire suppression system is disclosed. The sprinkler head is protected by a cover. The tool is formed from an elongated body having a cavity that is sized to receive the cover. One end of the body interfaces with a wrench, the other end has one or more axially extending slots sized to receive the fingers of a torque plate affixed to the sprinkler head. The sprinkler head has a threaded nipple that engages the threaded fitting. The nipple is engaged with the fitting and torque is applied to it by engaging the slots of the tool with the fingers and turning the tool with the wrench. The tool has an external index allowing the sprinkler head to be angularly oriented to direct its discharge stream.

10 Claims, 6 Drawing Sheets

TORQUE PLATE TOOL AND METHOD FOR SPRINKLER HEAD INSTALLATION

FIELD OF THE INVENTION

The invention relates to sprinkler heads used for fire suppression and to a tool and a method for installing sprinkler heads in a piping network.

BACKGROUND OF THE INVENTION

Fire suppression systems are used extensively in office buildings, warehouses, factories, hotels, homes and other buildings and structures to provide a reliable and effective means to suppress the spread of fire throughout the building or structure. Such systems may comprise a piping network extending throughout the building. The piping network is connected to a source of fire suppressing fluid, for example, water, and is in fluid communication with sprinkler heads distributed throughout the building which will discharge the fire suppressing fluid in the event of a fire.

Each sprinkler head has a discharge orifice with a valve that is biased into a normally open position, but is held in a closed position against the biasing force by a frangible glass bulb that contains a heat-sensitive fluid. The bulb is elongate in design and the biasing force places it under compression along its long axis. The bulb is very strong in compression along its long axis but easily breaks when force is applied transverse to this axis. During a fire, the heat-sensitive fluid expands within the bulb and when a predetermined temperature is reached the heat-sensitive fluid applies hydraulic pressure outwardly against the bulb normal to the long axis, causing the bulb to shatter, and thereby allow the valve to open and discharge the fire suppressing fluid.

The bulb is designed to break at the predetermined temperature and, when installed properly, is very reliable. However, the bulb must be frangible to operate effectively and is typically made of glass which is susceptible to damage. Damage which can compromise the performance of the bulb may be caused during packing, shipping or installation of the sprinkler head and may comprise a scratch or nick in the bulb caused by a tool or another sprinkler head, as well as a crack or a small hole which allows the heat-sensitive fluid to escape. If such damage is not prevented or at least mitigated, then it is possible that the bulb may fail prematurely at a temperature lower than the predetermined temperature, thus, triggering discharge from the sprinkler head in the absence of a fire condition. This may result in extensive water damage to the building and its contents. More seriously, the damage may prevent the sprinkler head from discharging at all, as may happen if the heat-sensitive fluid is permitted to leak out. This condition will compromise the fire safety of the building and should be avoided. It is, therefore, desirable to protect such frangible items during handling, packing, shipping and installation of the sprinkler heads to ensure that they function properly when the fire suppression system is brought on line.

Proper functioning of the sprinkler head may also be prevented by foreign matter, such as paint, plaster, drywall joint compound and spackle, covering the bulb and/or discharge orifice. If the sprinkler heads are not covered when the ceiling or walls from which they protrude are being finished, for example by painting or plastering, then it is likely that paint will be sprayed or brushed onto some sprinkler heads or plaster may coat the bulb or the orifice. This must be avoided if the sprinkler heads are to operate as intended. The problem is further complicated when recessed sprinkler heads are used, because for recessed installations, there is a greater likelihood of contamination of the sprinkler head since, being partially recessed, it is closer to the surfaces being finished.

While covers have been proposed to solve the aforementioned problems, some covers only protect the bulb from damage and leave the discharge orifice exposed to contaminants. Other covers, which protect the entire sprinkler head, do not make any provisions for using tools to install the sprinkler heads. Therefore, the installation procedure is cumbersome because the cover, initially installed over the sprinkler head for protection during shipping and handling, must be removed to allow the use of tools (typically a wrench to apply torque to a threaded nipple) for installation of the sprinkler head into the piping network. Removal of the cover to provide access for tools leaves the bulb vulnerable during installation. Furthermore, to provide protection to the sprinkler head during later finishing of the ceiling or wall, the cover must be replaced over the sprinkler head. This is often not done, the covers being lost or deliberately discarded.

There is clearly a need for an apparatus that will protect the sprinkler head from damage during shipping, and handling, will not interfere with installation or inhibit tools from being used, and will further protect the sprinkler head during finishing work, such as painting or plastering, and be readily removable to expose the sprinkler to the ambient, ready for proper operation.

SUMMARY OF THE INVENTION

The invention concerns a sprinkler head assembly attachable to a piping network by using a tool for applying torque to the sprinkler head. The sprinkler head assembly comprises a sprinkler head having a discharge orifice and a threaded nipple for attachment to the piping network. A torque plate is fixedly attached to the sprinkler head between the nipple and the orifice. The torque plate comprises a base portion having an aperture therethrough for receiving the sprinkler head, and a plurality of fingers projecting transversely outwardly from the base portion. The fingers are engageable with the tool and transmit torque to the sprinkler head for rotating the threaded nipple when the tool is engaged with the fingers and turned.

Preferably, the sprinkler head assembly also includes a removable cover for protecting the sprinkler head. The cover has an elongated sidewall positionable surrounding the discharge orifice. The cover has a plurality of lengthwise extending slots at one end, the slots being positioned to receive the transversely projecting fingers of the torque plate. The fingers projecting outwardly through the slots beyond the sidewall for engagement with the tool when the cover is positioned surrounding the discharge orifice.

The sprinkler head assembly may also include a collar having a plate member attached in overlying relation to the base portion of the torque plate. The plate member has an opening therethrough aligned with the aperture for receiving the sprinkler head. The plate member also has a circumferential sidewall surrounding the base portion, the sidewall being engageable with an escutcheon for attaching the escutcheon to the sprinkler head. The fingers of the torque plate extend outwardly through the sidewall.

The escutcheon, also part of the assembly, has an axially extending sleeve adapted to co-axially surround the sidewall of the collar for attaching the escutcheon to the sprinkler head. The sleeve has a plurality of lengthwise extending slots adapted to receive the fingers thereby permitting axial adjustment of the escutcheon relatively to the collar.

The invention further concerns a tool for installing the above described sprinkler head assembly into a piping network. The tool comprises an elongated body defining a cavity sized to receive the cover. The body has a first end adapted to engage a wrench and a second end having a plurality of lengthwise extending slots sized and positioned to receive the fingers of the torque plate when the body is positioned with the cover within the cavity. The slots engage the fingers and apply torque to the sprinkler head when the elongated body is turned.

Preferably, one of the slots is narrower than other of the slots. The narrower slot is adapted to receive one of the fingers that is narrower than other of the fingers. The narrower slot and finger provide an indicator for rotatably orienting the sprinkler head, the sprinkler head having a preferred orientation for directing discharge therefrom.

The invention also concerns a method of installing the above-described sprinkler head in a piping network using the aforementioned tool. The method comprises the steps of:

(A) providing a sprinkler head having a discharge orifice, a threaded nipple and at least one finger projecting transversely outwardly therefrom;

(B) providing a removable cover having an elongated sidewall positioned surrounding the discharge orifice, one end of the cover having a lengthwise extending slot at one end positioned to receive the finger, the finger projecting outwardly through the slot;

(C) providing a tool comprising an elongated body defining a cavity sized to receive the cover, the body having a first end adapted to engage a wrench and a second end having one or more lengthwise extending slots sized and positioned to receive the finger or fingers when the body is positioned with the cover within the cavity;

(D) engaging the nipple with the threaded fitting;

(E) positioning the tool with the cover received within the cavity and the finger or fingers received within the slot or slots;

(F) engaging a wrench with the first end of the tool;

(G) turning the tool with the wrench thereby applying torque to the nipple, the sprinkler head being attached to the piping network by screw action between the threaded nipple and the threaded fitting;

(H) removing the tool from the sprinkler head.

In an additional step, the cover is removed from the sprinkler head. Preferably, this occurs after all work in the area of the sprinkler head, such as painting and plastering, is complete.

The method may also include the step of using a locating index on the tool to rotate the sprinkler head to a predetermined angular position.

DETAILED DESCRIPTION OF PREFERRED EMBODIMENTS

Figure 1:
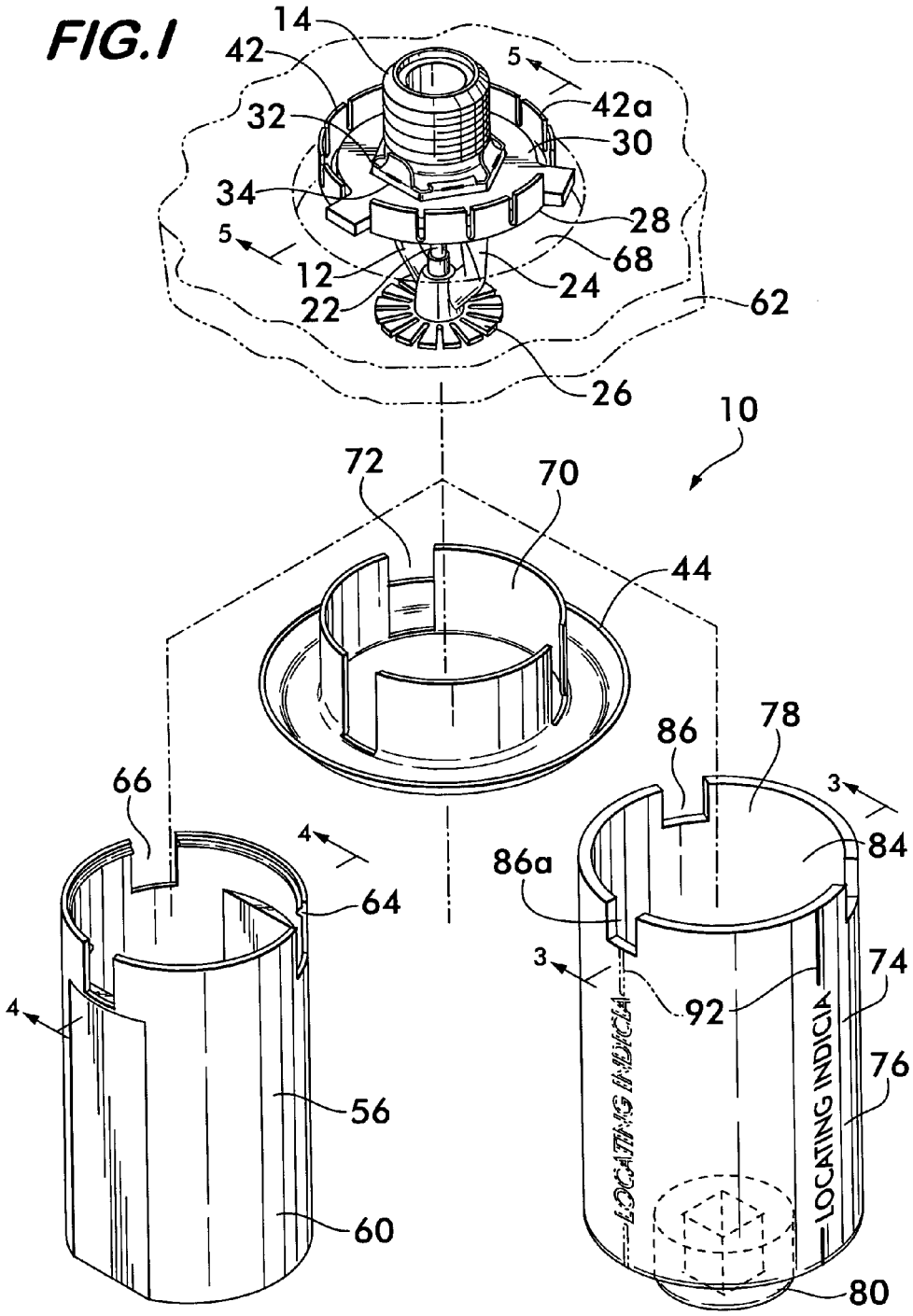
FIG. 1 is a perspective view of the component parts of a sprinkler head assembly and an installation tool according to the invention.

FIG. 1 illustrates the components of the sprinkler head assembly 10 according to the invention. Assembly 10 includes a sprinkler head 12 having a threaded nipple 14 for installing the head into a fitting of a piping network 16, partially shown in FIG. 3. Nipple 14 extends from a valve 18 having a discharge orifice 20 (see FIG. 6). With reference again to FIG. 3, valve 18 is normally biased into an open configuration but is held closed by a frangible glass bulb 22. As best shown in FIG. 1, bulb 22 is supported by two opposed arms 24 that extend from the valve 18 and also support a deflector plate 26. The bulb is held under compression by the valve biasing force, thereby keeping the valve 18 closed. Heat sensitive liquid within bulb 22 expands and causes the bulb to fracture when the ambient temperature surrounding the bulb reaches a predetermined elevated value indicative of a fire condition. When the bulb fractures, it allows the valve to open and discharge water through the discharge orifice 20.

Figure 3:
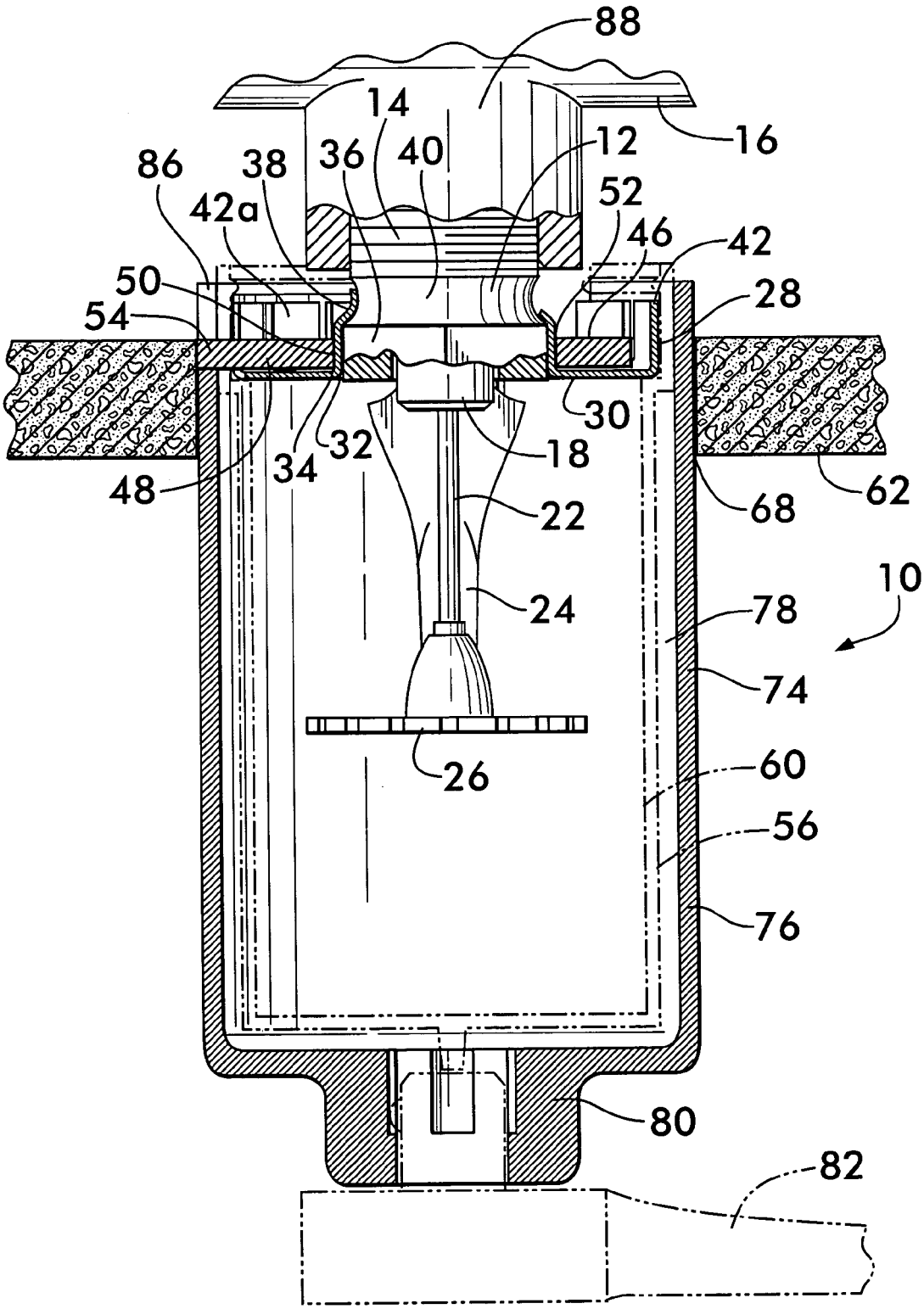
FIG. 3 is a longitudinal sectional view taken at line 3—3 of FIG. 1.

As shown in FIG. 3, a collar 28 is positioned between nipple 14 and valve 18. Collar 28 includes a plate member 30 having an opening 32 that receives the sprinkler head 12. As best shown in FIG. 1, the opening 32 has a polygonal perimeter 34 that accommodates a complementary perimeter 36 on the sprinkler head 12. The opening perimeter in the preferred embodiment is hexagonal to prevent the collar 28 from turning independently of the sprinkler head 12 when torque is applied, as described below. Attachment of the collar 28 to the sprinkler head 12 is effected by tabs 38 positioned on the perimeter 34, the tabs being crimped into a circumferential groove 40 positioned on the sprinkler head adjacent to the nipple 14. A sidewall 42 defines the outer perimeter of the plate member 30. The sidewall 42 is preferably discontinuous, formed by a plurality of segments 42*a* that are bent at a right angle to the plate member 30. Sidewall 42 engages the escutcheon 44, shown in FIG. 1 and described below.

Again with reference to FIG. 3, a torque plate 46 is positioned overlying the collar 28. Torque plate 46 is formed from a base portion 48 that is attached to the plate member 30 of the collar 28. Attachment is effected preferably by welding for metal parts. Base portion 48 has an aperture 50 for receiving the sprinkler head 12. Aperture 50 is aligned with opening 32 in collar 28, and preferably also has a perimeter 52 complementary to the interfacing perimeter of the sprinkler head, preferably hexagonal, as shown. One or more fingers 54 project transversely outwardly from base portion 48. Fingers 54 are preferably co-planar with base portion 48 and, when more than one are present, are spaced at equal angular intervals around the base portion. The fingers 54 project outwardly beyond the sidewall 42 and provide engagement points for a tool used to apply torque to the assembly 10 as described below. Preferably, fingers 54 project substantially radially from an axis centered in the aperture 50. It is noted that the torque plate 46 is attached to the sprinkler head through the collar 28. However, it is clear that the torque plate could also be attached directly to the sprinkler head 12 without the collar. For example, tabs 38 could easily extend from perimeter 52 of base portion 48 for attachment of the torque plate directly to the sprinkler head.

Figure 4:
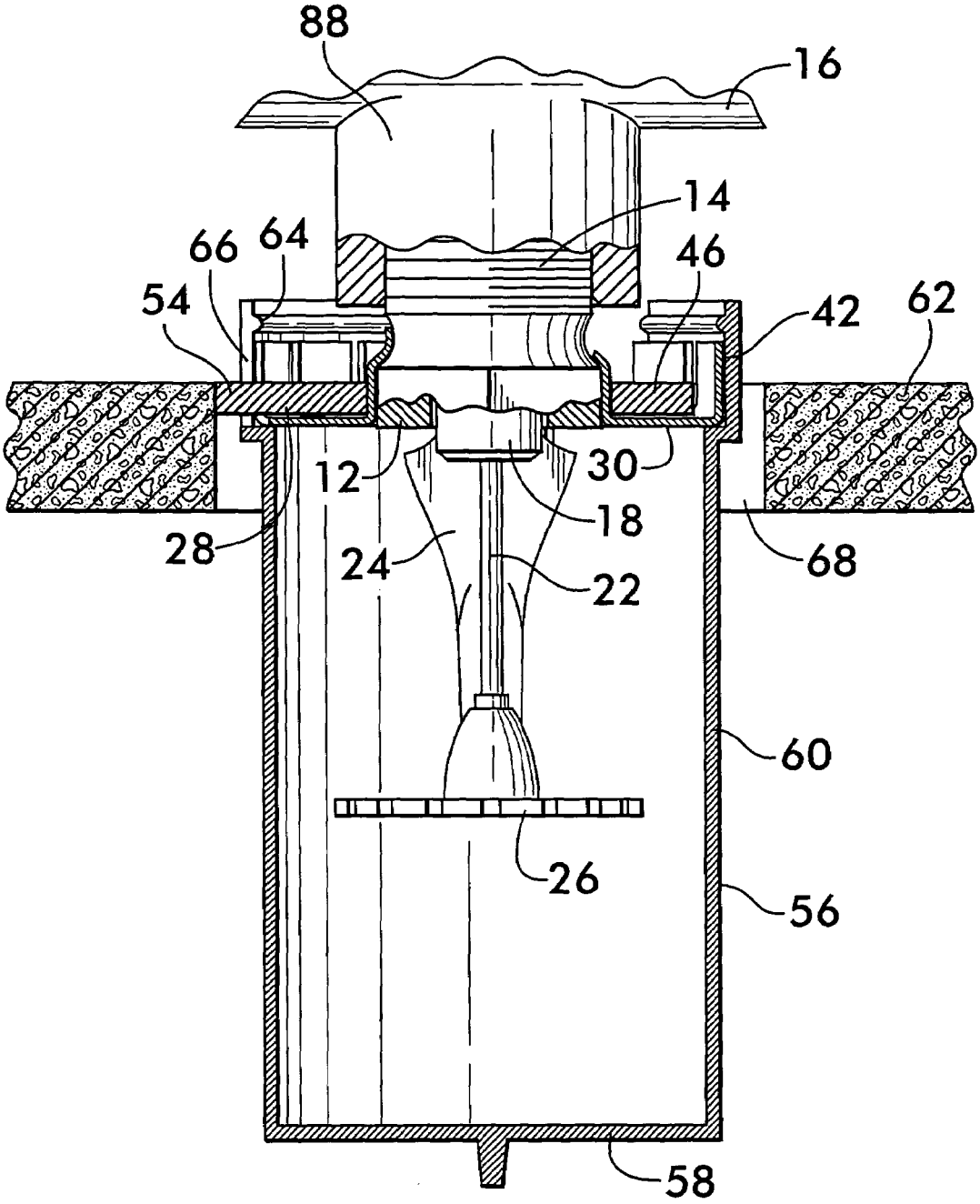
FIG. 4 is a longitudinal sectional view taken at line 4—4 of FIG. 1.

As shown in FIG. 1, sprinkler head assembly 10 may also include a removable protective cover 56. Cover 56 is preferably molded from a resilient, flexible plastic and, as shown in FIG. 4, has a bottom 58 and an elongated sidewall 60 that enclose the valve 18, discharge orifice 20, glass bulb 22, arms 24 and deflector plate 26 when the cover is mounted on the sprinkler head. The cover 56 is preferably mounted on the sprinkler head at the factory and remains in place during packing, shipping, handling, assembly of the sprinkler head into the piping network 16 and throughout painting and other finishing work such as plastering that is performed on the ceiling 62 or other structure through which the sprinkler head projects. The closed cover 56 is particularly effective at protecting the bulb 22 from damage or breakage and also protects the bulb, valve 18 and the discharge orifice 20 from contaminants such as dust, dirt, paint, plaster, drywall joint compound and the like which may be encountered during manufacture and at the construction site. The end of the cover 56 opposite bottom 58 is open and sized to engage the sidewall 42 of the collar 28. Attachment may be by a friction fit between the cover and the sidewall, or by inclusion of an inwardly projecting retaining lip 64 that engages the sidewall 42 to provide a positive locking action to prevent inadvertent removal of the cover. One or more slots 66 are positioned at the open end of cover 56 (see also FIG. 1) to accommodate fingers 54 of the torque plate 46. The fingers project beyond the cover sidewall 60 so that they may be engaged by a tool with the cover in place. Because it is flexible, the cover can be readily deformed and removed from the sprinkler head at the appropriate time when there is no longer a significant threat of damage or contamination.

Figure 5:
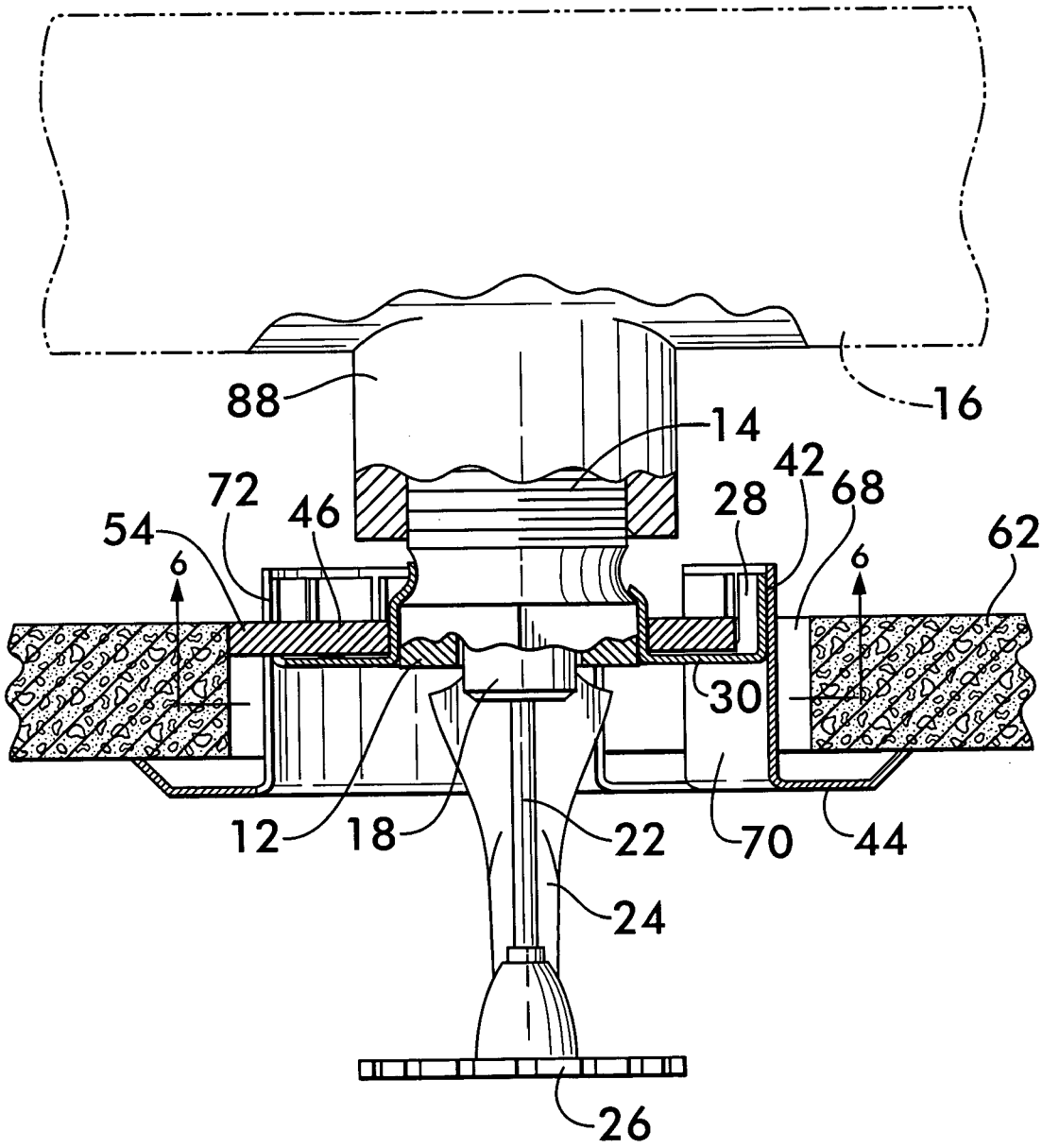
FIG. 5 is a longitudinal sectional view taken at line 5—5 of FIG. 1.

As further shown in FIG. 1, sprinkler head assembly 10 may also include an escutcheon 44. Escutcheon 44 mounts on the collar 28 after the cover 56 is removed. Mounting of the escutcheon, as shown in FIG. 5, is typically the last step in the installation of the sprinkler head 12, and is used to hide the hole 68 in the ceiling 62 through which the sprinkler head projects. As best illustrated in FIG. 1, the escutcheon 44 includes an axially extending sleeve 70 adapted to co-axially surround the sidewall 42 of the collar 28 for attachment of the escutcheon to the sprinkler head. Attachment is preferably by a friction fit between the sleeve 70 and the sidewall 42. The sleeve has a plurality of lengthwise extending slots 72 adapted to receive the fingers 54 of the torque plate 46. The slots permit axial adjustment of the escutcheon 44 relatively to the collar 28 to account for variations in the position of the sprinkler head 12 with respect to ceiling 62.

Figures 2, 7:
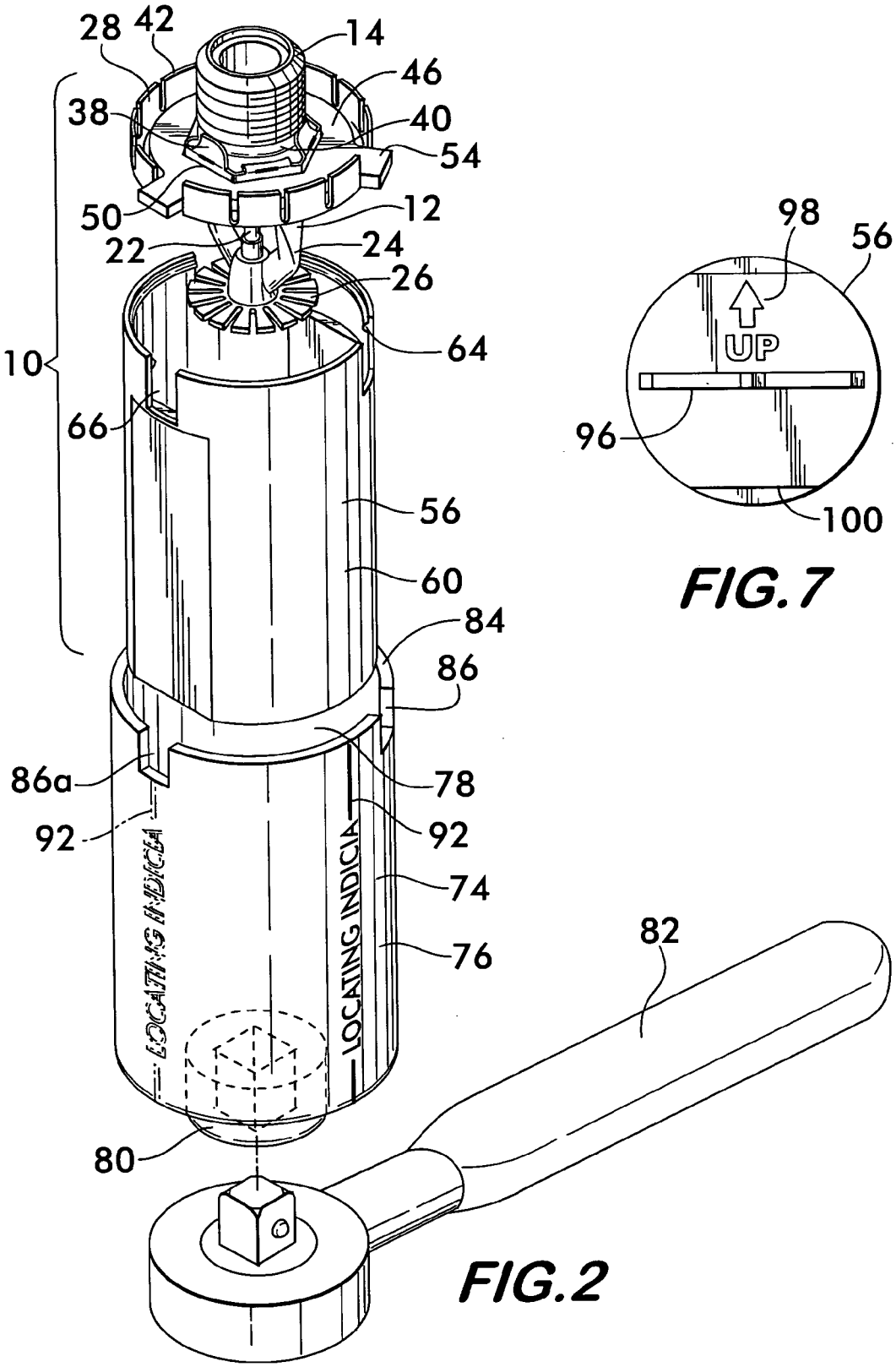
FIG. 2 is an exploded perspective view illustrating the engagement of the installation tool with a sprinkler head assembly.
FIG. 7 is an end view of a component of the sprinkler head assembly.

Installation of the sprinkler head assembly is effected using the tool 74 shown in FIGS. 1 and 2. Tool 74 is formed from an elongated body 76 that defines a cavity 78 sized to receive the cover 56. The body 76 has a first end 80 adapted to engage a wrench, for example, a rachet wrench 82 as shown in FIG. 2. The opposite end 84 of the body 76 is open to receive the cover and has a plurality of lengthwise extending slots 86 sized and positioned to receive the fingers 54 when the body 76 is positioned with the cover within the cavity (see FIG. 3). The slots 86 engage the fingers 54 and apply torque to the sprinkler head when the tool 74 is rotated.

Installation of the sprinkler head 12 into a piping network 16 through a hole 68 in a ceiling 62 is illustrated in FIGS. 3–6. As shown in FIG. 3, the sprinkler head assembly 10 with cover 56 in place is threaded into a threaded fitting 88 of piping network 16 using threaded nipple 14. The initial assembly may be by hand to prevent cross threading, but once significant rotational resistance is encountered, tool 74 is used. Wrench 82 is engaged with end 80 of tool 74 and the tool body 76 is slipped over cover 56, the cover being received within the cavity 78. The tool is advanced axially until slots 86 engage the fingers 54 of torque plate 46. The wrench 82 may then be turned, applying torque to the sprinkler head 12 through the torque plate 46, which may be attached to the sprinkler head directly, or as shown, through the collar 28.

As shown in FIG. 4, once the nipple 14 is properly engaged with fitting 88 the tool 74 is removed. At this point, the cover 56 may remain in place so that ceiling 62 may be finished by painting or plastering for example. The sprinkler head 12 is fully protected from damage and contaminants by the cover.

As shown in FIG. 5, once the finishing tasks are completed the cover 56 may be manually removed and the escutcheon 44 installed to hide the hole 68 and provide a finished appearance to the installation.

Figure 6:
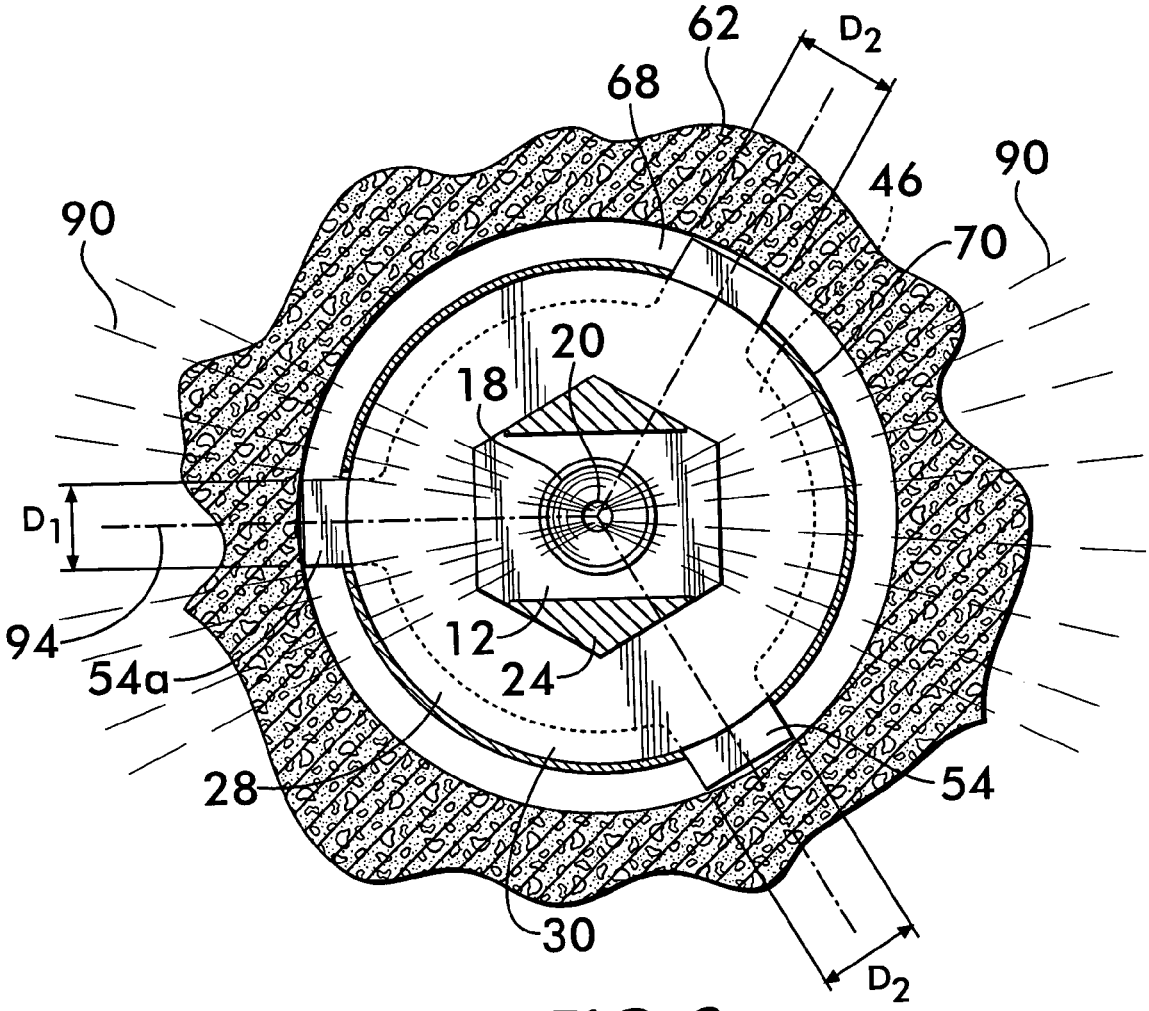
FIG. 6 is a cross-sectional view taken at line 6—6 of FIG. 5.

It is often desired to orient the sprinkler head so that its spray pattern 90, as shown in FIG. 6, is directed along a particular line of action indicated by a line 94. Spray pattern 90 exits the sprinkler head substantially perpendicularly to a plane passing through arms 24. Thus it is desirable to orient the sprinkler head 12 so that the plane containing arms 24 faces in a desired predetermined direction. To enable the desired orientation of the sprinkler head to be achieved during installation when the sprinkler head is hidden beneath the cover 56 and the tool 74 (which rotates the sprinkler head to effect the desired orientation) a locating index 92 is placed on the outside surface of body 76 of the tool as shown in FIGS. 1 and 2. The locating index 92 always maintains a known relationship with the plane of arms 24. In a preferred embodiment, the index 92 is aligned with the plane of the arms 24. As shown in FIG. 6, coordination of the locating index 92 with the plane of arms 24 is ensured by positioning one of the fingers 54*a* of torque plate 46 along line 94 and making the width D1 of this finger different from the widths D2 of the other fingers, when present. Preferably, width D1 is narrower than widths D2. As shown in FIGS. 1 and 2, the slots 86 in the tool 74 are also made having different widths, with the slot 86*a* being narrower than the remaining slots. Thus, the tool 74 may only engage the fingers 54 of the torque plate 46 with narrower width slot 86*a* engaging the narrower width finger 54*a*. Locating index 92 is positioned at an angular separation of about 90 degrees from slot 86*a*, and this ensures that the locating index 92 will always align properly with respect to arms 24 and thus may be used to "aim" the sprinkler head so that its spray pattern 90 projects along a desired line of action.

In another embodiment, the index 92, shown in phantom line in FIGS. 1 and 2, is aligned with slot 86*a* and corresponds substantially to the predominant direction of the spray pattern 90. In this embodiment the sprinkler head is aimed by positioning the locating index along the desired direction of the spray pattern.

As shown in FIG. 7, cover 56 may also be used to align the sprinkler head. This is advantageous when the sprinkler head is wall mounted in a horizontal orientation, as there is not only a desired direction for the spray pattern, there is also a preferred up-side and down-side of the sprinkler head that should be observed. To that end the cover 56 has an orienting index 96, preferably in the form of a raised bar that identifies the plane of the arms 24. Further indicia, such as arrow 98 indicate the up-side of the sprinkler. Alignment of the cover appropriately with the sprinkler is ensured by varying the widths of slots 66 (see FIG. 1) so that the cover may only engage the fingers 54 in a way that ensures its appropriate orientation relatively to the sprinkler head. It is further noted that the cover 56 is not round in cross section, but may have one or more flat surfaces 100 which also aid in alignment of the sprinkler prior to removal of the cover.

Sprinkler assemblies according to the invention installed using a tool according to the invention provide for protection of the sprinkler head and its delicate glass bulb during handling, shipping, installation and post installation finishing while also enabling an efficient installation to be effected.

What is claimed is:

1. In combination, a tool and a torque plate for installing a sprinkler head assembly into a piping network, said sprinkler head assembly including a sprinkler head having a discharge orifice and a threaded nipple for attachment to said piping network, said combination comprising:

said torque plate fixedly attached to said sprinkler head, said torque plate having a base portion with an aperture therethrough for receiving said sprinkler head, a plurality of fingers projecting outwardly from said base portion, one of said fingers being narrower than other of said fingers, said narrower finger providing an orientation indicator for assisting an installer in rotatably orienting said sprinkler head, said fingers being engageable with said tool and transmitting torque to said sprinkler head for rotating said threaded nipple when said tool is engaged with said fingers and turned, said combination further including a removable cover for protecting said sprinkler head, said cover having an elongated sidewall positioned surrounding said sprinkler head, said tool comprising:

an elongated body defining a cavity sized to receive said cover, one end of said body having a plurality of lengthwise extending slots sized and positioned to receive said fingers when said body is positioned with said cover within said cavity, said slots engaging said fingers and applying torque to said sprinkler head when said elongated body is turned.

2. A tool according to claim 1, further comprising an index mark on an outer surface of said elongated body, said index mark providing visual indication of the orientation of said sprinkler head.

3. A tool according to claim 2, wherein one of said slots is narrower than other of said slots, said narrower slot adapted to receive said fingers that is narrower than other of said fingers, said narrower slot and finger facilitating orienting of said tool relatively to said sprinkler head.

4. A tool according to claim 3, wherein said index mark is aligned with said narrower slot.

5. A tool according to claim 3, wherein said index mark is positioned at an angular separation of about 90 degrees to said narrower slot.

6. In combination, a tool and a torque plate for installing a sprinkler head assembly into a piping network, said sprinkler head assembly including a sprinkler head having a discharge orifice and a threaded nipple for attachment to said piping network, said combination comprising:

said torque plate fixedly attached to said sprinkler head, said torque plate having a base portion with an aperture therethrough for receiving said sprinkler head, at least one finger projecting outwardly from said torque plate, said finger being engageable with said tool and transmitting torque to said sprinkler head for rotating said threaded nipple when said tool is engaged with said finger and turned, said combination further including a removable cover for protecting said sprinkler head, said cover having an elongated sidewall positioned surrounding said sprinkler head, said tool comprising:

an elongated body defining a cavity sized to receive said cover, said body having at least one lengthwise extending slot positioned at one end thereof, said slot being sized and positioned to receive said finger when said body is positioned with said cover received within said cavity, said slot engaging said finger and applying torque to said sprinkler head when said elongated body is turned.

7. A tool according to claim 6, wherein an opposite end of said body is adapted to engage a wrench for applying torque to said body.

8. A method of installing a sprinkler head in a piping network using a tool, said piping network having a threaded fitting adapted to receive said sprinkler head, said method comprising the steps of:

providing a sprinkler head having a discharge orifice, a threaded nipple, a torque elate having a base portion with an aperture therethrough for receiving said sprinkler head, said base portion being attached to said sprinkler head, and a finger projecting transversely outwardly from said base portion;

providing a removable cover having an elongated sidewall positioned surrounding said sprinkler head;

providing a tool comprising an elongated body defining a cavity sized to receive said cover, one end of said body having a lengthwise extending slot sized and positioned to receive said finger when said body is positioned with said cover within said cavity;

engaging said nipple with said threaded fitting;

positioning said tool with said cover received within said cavity and said finger received within said slot;

turning said tool thereby applying torque to said nipple, said sprinkler head being attached to said piping network by screw action between said threaded nipple and said threaded fitting; and removing said tool from said sprinkler head.

9. A method according to claim 8, further comprising the step of removing said cover from said sprinkler head.

10. A method according to claim 8, further comprising the step of using a locating index on said tool to rotate said sprinkler head to a predetermined angular position.

* * * * *